US008801584B2

(12) United States Patent
Yim

(10) Patent No.: US 8,801,584 B2
(45) Date of Patent: Aug. 12, 2014

(54) SIT-UP EXCERCISER HAVING SECONDARY PURPOSE OF PROMOTING BOWEL MOVEMENT

(76) Inventor: Kang Jun Yim, Gyeonggi-Do (KR)

( * ) Notice: Subject to any disclaimer, the term of this patent is extended or adjusted under 35 U.S.C. 154(b) by 369 days.

(21) Appl. No.: 13/282,829

(22) Filed: Oct. 27, 2011

(65) Prior Publication Data

US 2013/0109550 A1 May 2, 2013

(51) Int. Cl.
*A63B 26/00* (2006.01)

(52) U.S. Cl.
USPC ..... 482/140; 482/142; 601/5

(58) Field of Classification Search
USPC ..... 482/51, 55, 56, 140, 142, 907; 5/600, 5/613, 617, 618; 601/1, 5, 23, 24, 26
See application file for complete search history.

(56) References Cited

U.S. PATENT DOCUMENTS 5,163,890 A * 11/1992 Perry, Jr. ..... 482/142
5,282,835 A * 2/1994 Wright et al. ..... 606/242
5,500,002 A * 3/1996 Riddle et al. ..... 606/242
7,341,565 B2 * 3/2008 Splane et al. ..... 601/5
7,540,877 B2 * 6/2009 Emsky ..... 606/242
7,645,219 B1 * 1/2010 Buth ..... 482/142
2003/0139266 A1 * 7/2003 Lin et al. ..... 482/140
2005/0101460 A1 * 5/2005 Lobban ..... 482/140

* cited by examiner

*Primary Examiner* — Loan H Thanh
*Assistant Examiner* — Nyca T Nguyen
(74) *Attorney, Agent, or Firm* — Millen, White, Zelano & Branigan, P.C.

(57) ABSTRACT

A sit-up exerciser having a secondary purpose of promoting a bowel movement. Two pivot plates correspondingly pivot, a waist support plate is disposed between the pivot plates to prevent the waist from slipping, and the pivoting angle of the pivot plates can be easily adjusted, so that a person who needs to exercise his or her waist can easily exercise it while having his/her bowel movement facilitated in order to promote the health. The pivoting angle of the pivot plates can be easily adjusted to control the intensity of the exercise, the pivoting speed of the pivot plates can be adjusted to be fast or slow, the temperature of the pivot plates can be adjusted from room temperature up to 70° C. so that the temperature of the surface of the pivot plates can be controlled, and the operating time can be adjusted depending on user's preference.

2 Claims, 3 Drawing Sheets

SIT-UP EXCERCISER HAVING SECONDARY PURPOSE OF PROMOTING BOWEL MOVEMENT

BACKGROUND OF THE INVENTION

1. Field of the Invention

The present invention relates, in general, to a sit-up exerciser facilitating the bowel movement of a user and exercising the waist. More particularly, the present invention relates to a sit-up exerciser having a secondary purpose of promoting a bowel movement, in which two pivot plates correspondingly pivot, a waist support plate is disposed between the pivot plates to prevent the waist from slipping, and the pivoting angle of the pivot plates can be easily adjusted, so that a person who needs to exercise his or her waist can easily exercise it while having his/her bowel movement facilitated in order to promote the health. In addition, the pivoting angle of the pivot plates can be easily adjusted to control the intensity of the exercise, the pivoting speed of the pivot plates can be adjusted to be fast or slow, the temperature of the pivot plates can be adjusted from room temperature up to 70° C. so that the temperature of the surface of the pivot plates can be controlled, and the operating time can be adjusted so that the user can do the exercise that he or she has a preference for.

2. Description of the Related Art

In general, modern people who are leading complicated and busy lives suffer from stress of a variety of different sources. There is a tendency for an increasing number of office workers to exercise in health clubs in order to alleviate such stress. In the case of alleviating the stress by exercising, it is known that quiet exercise is more effective than energetic exercise at doing this. Also in the case of the quiet exercise, it is preferable that the user perform the exercise, for example, while he/she is reading a book on his/her back.

In addition, all forces of the human body come from the waist and it has been reported that about 95% of diseases originate in the waist, which is closely related to the five viscera and the six entrails. Therefore, the waist may be regarded as the most important part of the human body.

However, sporting goods that are currently used in most health clubs are mainly designed to exercise muscles, and thus the health club is not a place that is preferable for a person who needs to exercise his/her waist.

In addition, even if a waist exerciser is provided, such a waist exerciser is configured such that a pivot plate pivots only to the right and left. The waist exerciser is not equipped with any functions for heating the pivot plate or for adjusting the pivoting angle or the pivoting speed of the plate. Consequently, the effect of the exercise is not significant.

SUMMARY OF THE INVENTION

Accordingly, the present invention has been made keeping in mind the above problems occurring in the related art, and the present invention is intended to propose a sit-up exerciser having a secondary purpose of promoting a bowel movement, in which a user can effectively exercise the waist while saving time, since he/she can exercise the waist while he/she is conveniently taking a nap or reading a book while lying on the back or stomach. The user can exercise while performing a warm fomentation by selecting the temperature that is most suitable to increasing the efficiency of the exercise and alleviating stress, since the temperature of the pivot plates can be set to in several different stages. In addition, the user can efficiently perform exercise by setting a speed suitable to him/her, since the pivoting speed of the pivot plates can be set to several stages. Furthermore, the exerciser enables the user to set the pivoting angle of the pivot plates to any one of three stages so that the user can more efficiently exercise, thereby providing the optimal waist exercising effect to the user.

In order to achieve the above object, according to one aspect of the present invention, there is provided a sit-up exerciser having a secondary purpose of promoting a bowel movement, including an exerciser body inside which first and second pivot shafts are pivotally fixed; a first drive motor disposed adjacent to the second pivot shaft inside the exerciser body, the first drive motor having a rotary plate attached thereto; a first pivot lever, in which one end of the first pivot lever is fixed to the rotary plate of the first drive motor, and the other end of the first pivot lever is fixed to a first pivot arm, in which the first pivot arm is fixed to the first pivot shaft and extends horizontally therefrom; a first pivot arm fixed to the first pivot shaft, in which one end of the first pivot lever is fixed to one end of the first pivot arm, and a second drive motor is disposed on the other end of the first pivot arm; a second pivot arm, in which the second pivot arm is disposed on an upper portion of the first pivot arm of the first pivot shaft and extends horizontally therefrom; a second pivot lever, in which one end of the second pivot lever is fixed to the second pivot arm and the other end of the second pivot lever is fixed on the second pivot shaft by being hinged to a third pivot arm, the third pivot arm horizontally extending from the second pivot shaft; pivot plates disposed on the first and second pivot shafts, respectively, in which each of the pivot plates has a heating mattress therein; a waist support disposed between the pivot plates, in which the waist support is vertically movable by a third drive motor; and a control unit, in which the control unit controls a temperature of the heating mattress and a pivoting speed, a pivoting time and a pivoting angle of the pivot plates.

According to the sit-up exerciser having a secondary purpose of promoting a bowel movement of the present invention, the first and second pivot shafts are pivotally fixed inside the exerciser body. The first drive motor is disposed adjacent to the second pivot shaft inside the exerciser body, the first drive motor having the rotary plate attached thereto. One end of the first pivot lever is fixed to the rotary plate of the first drive motor, and the other end of the first pivot lever is fixed to the first pivot arm. The first pivot arm is fixed to the first pivot shaft and extends horizontally therefrom. The first pivot arm is fixed to the first pivot shaft. One end of the first pivot lever is fixed to one end of the first pivot arm, and the second drive motor is disposed on the other end of the first pivot arm. The second pivot arm is disposed on the upper portion of the first pivot arm of the first pivot shaft and extends horizontally therefrom. One end of the second pivot lever is fixed to the second pivot arm and the other end of the second pivot lever is fixed on the second pivot shaft by being hinged to the third pivot arm. The third pivot arm extends horizontally from the second pivot shaft. The pivot plates are disposed on the first and second pivot shafts, respectively. Each of the pivot plates has the heating mattress therein. The waist support is disposed between the pivot plates, and is vertically movable by the third drive motor. The control unit controls the temperature of the heating mattress and the pivoting speed, the pivoting time and the pivoting angle of the pivot plates. Accordingly, the user can effectively exercise the waist while saving time, since he/she can exercise the waist while he/she is conveniently taking a nap or reading a book while lying on the back or stomach. The user can do exercise while performing a warm fomentation by selecting the temperature that is most suitable to increasing the efficiency of the exercise and alleviating stress, since the temperature of the pivot plates can be set to several different stages. In addition, the user can efficiently perform exercise by selecting the speed suitable to him/her, since the pivoting speed of the pivot plates can be set to several stages. Furthermore, the exerciser enables the user to set the pivoting angle of the pivot plates to any one of three stages so that the user can more efficiently exercise, thereby providing the user with the optimal waist exercise effect.

BRIEF DESCRIPTION OF THE DRAWINGS

The above and other objects, features and further advantages of the present invention will be more clearly understood from the following detailed description when taken in conjunction with the accompanying drawings, in which.

DETAILED DESCRIPTION OF THE INVENTION

Figure 1:
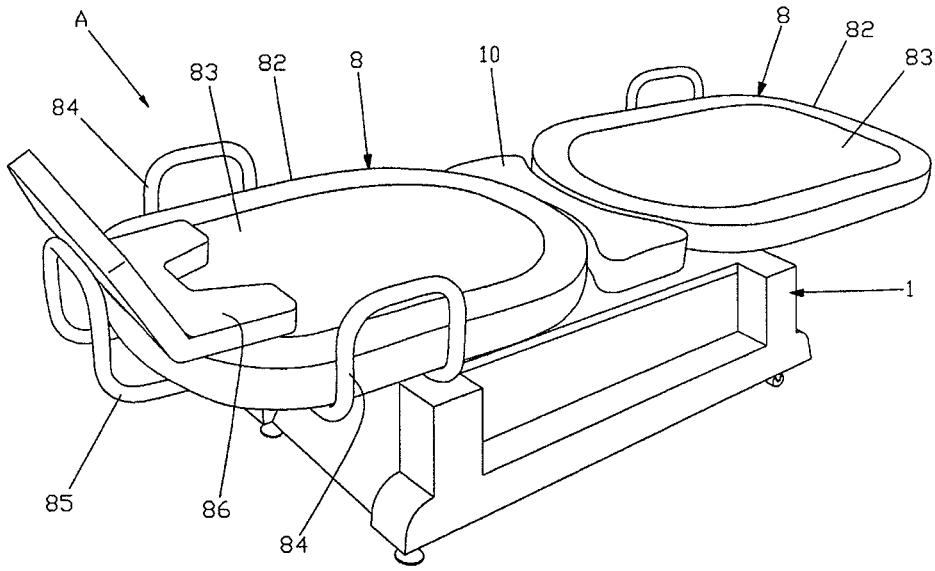
FIG. 1 a perspective view showing a sit-up exerciser having a secondary purpose of promoting a bowel movement according to a first embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2A:
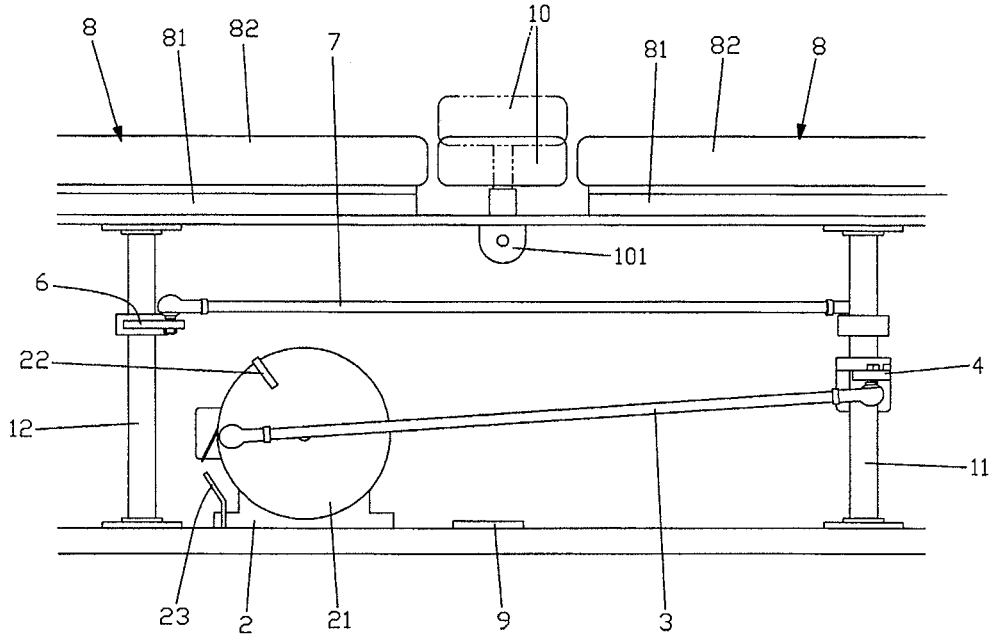
FIG. 2A and FIG. 2B are front elevation and top-plan views schematically showing the drive unit disposed inside the sit-up exerciser having a secondary purpose of promoting a bowel movement according to the first embodiment of the present invention.
Figure 2B:
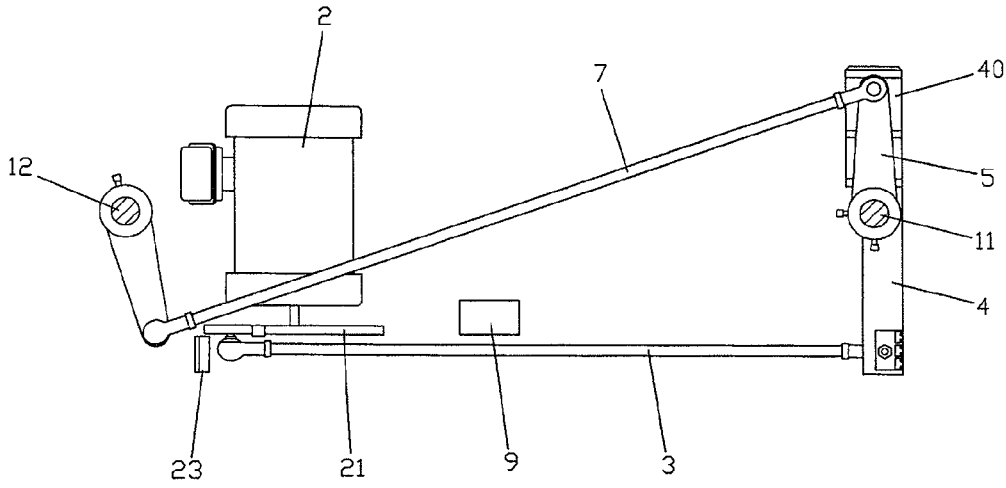
Figure 3:
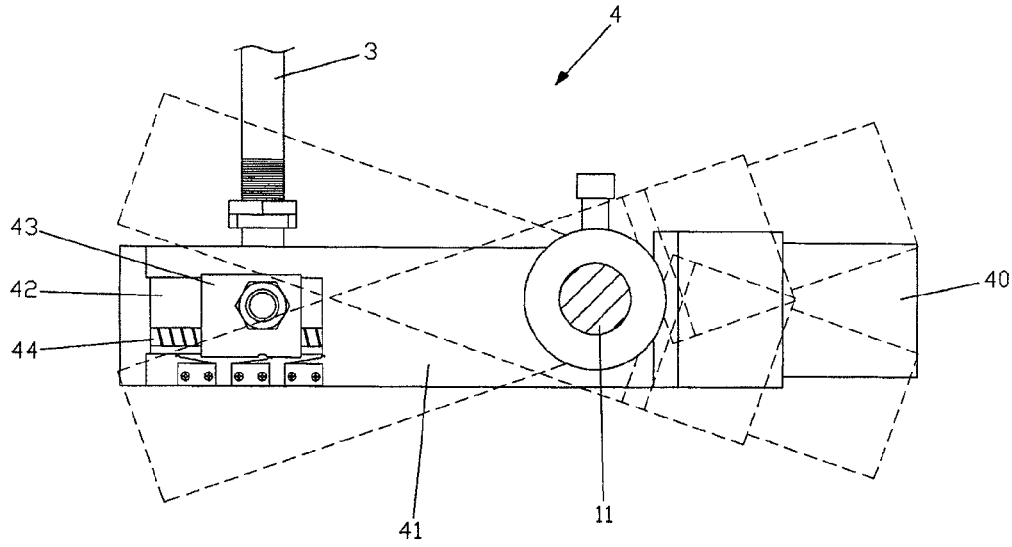
FIG. 3 is a top-plan view showing the first pivot arm for adjusting the angle to which the pivot plates pivot.
Figure 4:
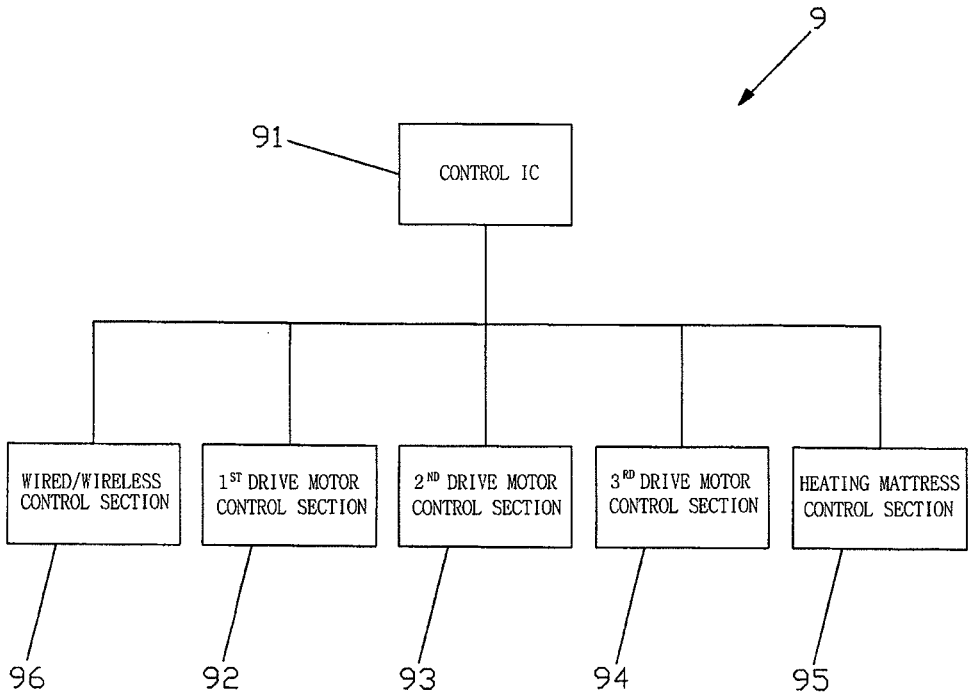
FIG. 4 is a block diagram showing the control unit of the sit-up exerciser having a secondary purpose of promoting a bowel movement according to the first embodiment of the present invention.

As shown in FIG. 1 to FIG. 3, a sit-up exerciser having a secondary purpose of promoting a bowel movement according to a first embodiment of the present invention includes an exerciser body 1 inside which first and second pivot shafts 11 and 12 are pivotally fixed. A first drive motor 2 is disposed adjacent to the second pivot shaft 12 inside the exerciser body 1, and has a rotary plate 21 attached thereto. One end of a first pivot lever 3 is fixed to the rotary plate 21 of the first drive motor 2 via a pivot bearing, and the other end of the first pivot level 3 is fixed to a first pivot arm 4 that is fixed to the first pivot shaft 11 and extends horizontally. The first pivot arm 4 is fixed to the first pivot shaft 11, in which one end of the first pivot lever 3 is fixed to one end of the first pivot arm 4, and a second drive motor 40 is disposed on the other end of the first pivot arm 4. A second pivot arm 5 is disposed on the upper portion of the first pivot arm 4 of the first pivot shaft 11, and extends horizontally. One end of a second pivot lever 7 is fixed to the second pivot arm 5, and the other end of the second pivot lever 7 is fixed on the second pivot shaft 12 by being hinged to a third pivot arm 6, which extends horizontally from the second pivot shaft 12. Pivot plates 8 are disposed on the first and second pivot shafts 11 and 12, respectively, and each of the pivot plates 8 has a heating mattress therein. A control unit 9 is configured to control the temperature of the heating mattresses of the pivot plates 8, as well as the pivoting speed, pivoting time, and pivoting angle of the pivot plates 8. The first pivot arm 4 and the first pivot lever 3 are connected and hingeably fixed to each other such that they pivot with respect to each other. The same connection is provided between the second pivot arm 5 and the second pivot lever 7 and between the third pivot arm 6 and the second pivot lever 7.

A waist support 10 is disposed between the pivot plates 8 such that it supports the lumbar of the waist of the user. The waist support 10 serves to support the waist while the body is being exercised in upward and downward directions, and has a third drive motor 101 in the lower end thereof such that the waist can be moved up and down as the waist is being exercised in the vertical direction.

The drive unit of this waist support has a third drive motor 101 disposed in the upper portion of the inside of the body of the exerciser, the third drive motor 101 being vertically mounted on the central portion of the underside of the waist support to provide power so that the waist support 10 can move up and down. In order to prevent the load on the waist due to excessive rise of the waist, a limit switch (not shown) is provided. The limit switch can control the operation of the waist support 10 when it rises to a predetermined height or higher.

A sensor plate 22, which can detect the number of rotations of the rotary plate 21, is fixed to a periphery of the rotary plate 21 of the first drive motor 2. An encoder 23, which is disposed adjacent to the rotary plate 21, detects the number of rotations of the rotary plate 21 while it is rotating.

One end of the first pivot lever 3 is joined and fixed to the rotary plate 21 via the pivot bearing, and the other end of the first pivot lever 3 is coupled and fixed to a fixing plate 43 of the first pivot arm 4.

The second drive motor 40 is disposed on one end of the first pivot arm 4, and one end of the first pivot lever 3 is fixedly hinged to the other end of the first pivot arm 4. The first pivot arm 4 has a fixing recess 42 inside the body 41 of the first pivot arm 4, and the fixing plate 43 is slidably disposed inside the fixing recess 42 such that it operates to slide inside the fixing recess 42. One end of the first pivot lever 3 is fixed on the fixing plate 43, and can slide inside the fixing recess 42 to adjust the pivoting angle of the first pivot shaft 11. That is, a carrier screw 44, which is rotated by the second drive motor 40, is disposed inside the fixing plate 43 such that the fixing plate 43 can be carried inside the fixing recess 42.

One end of the second pivot arm 5 is fixed to the upper portion of the first pivot shaft 11, and the second pivot lever 7 is mounted on the other end of the second pivot arm 5.

One end of the third pivot arm 6 is fixed to the second pivot shaft 12, and the other end of the third pivot arm 6 is fixed to the second pivot lever 7.

The pivot plates 8 include fixed plates 81, which are fixed to the first and second pivot shafts 11 and 12, respectively. Cushions 82 and heating mattresses 83 are disposed on the fixing plates 81. Two handles 84 are provided on one of the pivot plates 8, extending in the direction parallel to the exerciser body 1, and one handle 85 is provided on the same pivot plate 8, extending in the direction perpendicular to the exerciser body 1, such that the user can perform exercise in various postures. A head support 86 is provided on the handle 85 that extends in the perpendicular direction. The head support 86 has a cushion member so that the user can exercise in a comfortable posture.

The control section 9 includes a control Integrated Circuit (IC) 91, a first drive motor control section 92, a second drive motor control section 93, a third drive motor control section 94, a heating mattress control section 95 and a wired-wireless control section 96.

A description will be given below of the operation and effects of the sit-up exerciser having a secondary purpose of promoting a bowel movement according to the present invention having the above-described configuration.

When the user intends to use the sit-up exerciser having a secondary purpose of promoting a bowel movement A according to the first embodiment of the present invention, he/she lies first on the pivot plates 8 on the upper portion of the exerciser. In this state, the switch is turned on, and the pivoting speed of the pivot plates 8 is set to three-stage mode. When the pivot plates 8 are set to the three-stage mode, they pivot about 8 times, with the number of rotations of the first drive motor 2 being about 1000 rpm. For reference, the pivot plates 8 pivot 6 times (about 800 rpm) in the first stage, and 12 times (about 14000 rpm) in the seventh stage.

The operating time of the pivot plate 8 is selected from 20, 30, 40, 50 and 60 minutes. In this embodiment, the pivot plate 8 is operated by selecting 20 minutes.

When the temperature of the pivot plate 8 is set to a temperature of about 40° C., the heating mattresses 83 are heated to a temperature of about 40° C. In the state of the heating mattress 83 having been heated to a temperature of about 40° C., the user can enjoy being cozy while he/she is exercising. The heating temperature of the pivot plate 8 can be set from one of 20° C., 30° C., 40° C., 50° C., 60° C. and 70° C.

Regarding the adjustment of the pivoting angle of the pivot plate 8, the carriage screw 44 rotates following the rotation of the second drive motor 4. This consequently operates the fixing plate 43 coupled thereto to move away from or closer to the first pivot shaft 11, thereby determining the pivoting angle of the pivot plates 8. In this embodiment, when the pivot plate 8 is set to the middle stage mode, it pivots to about 30°. The pivoting angles to which the pivot plate 8 is set include three stages, i.e., weak, middle and strong. In the weak mode, the pivot plate 8 pivots to 13° about the center line, i.e. over the range of 26°. In the middle mode, the pivot plate 8 pivots to 15° about the center line, i.e. over the range of 30°. In the strong mode, the pivot plate 8 pivots to 18° about the center line, i.e. over the range of 36°. The pivoting angle of the pivot plate 8 increases as the pivot plate 8 moves away from the first pivot shaft 11, but decreases as the pivot plate 8 moves closer to the first pivot shaft 11.

In the sit-up exerciser having a secondary purpose of promoting a bowel movement A according to an embodiment of the present invention, the user may exercise in the posture in which he/she is facing up, with both hands folded on shoulders. In this state, when the pivot plate 8 pivots, the ligament and the cartilage of the user are aligned so that fat is removed from the sides. This posture can be regarded as assuming a posture that is amenable to removing the fat in the sides. The waist and its surrounding parts are exercised, thereby having the effects of preventing or alleviating a herniated intervertebral disc and removing the fat from the external oblique muscles of the hip joints.

In addition, when the user performs exercise to pivot the pivot plates 8 while lying on the side, the arms are raised up and down to stimulate the function of the bowels and the thoracic vertebrae, thereby removing stress and promoting digestive functions. In this case, the abdomen and the back are exercised, thereby strengthening the bowels and the heart. The physiological angle of the spine can be adjusted to retain the healthy shape of the spine.

In addition, an exercise that the user performs on his/her stomach by pivoting the pivot plates 8 is an exercise that is suitable to overcoming fatigue. This exercise can also adjust the function of the bowels by alleviating the stress of the abdomen, and effectively influences the kidneys, genitalia, liver and stomach. When exercising to the right and left, if it is inconvenient to bend to the right, it can be easily diagnosed that the spleen or male genitalia are malfunctioning. If it is inconvenient to bend to the left, it is easy to make the diagnosis that the kidney or ureter is malfunctioning or that there is bleeding. Such a posture provides effects in that the abnormal lateral curvature of the spine is corrected and that the bowels and the heart are strengthened.

When the user uses the exerciser having the foregoing functions, he/she can start to exercise after selecting the speed, angle, temperature and operating time according to his/her preference by using the wired/wireless control section. A memory function is provided such that it enables a movement to be repeated based on a specification selected by a user, provides a basic three-pattern menu by determining the level of an exercise, which matches the standard specifications of an average person according to respective motion variables (speed, angle, temperature and time), and strong and weak levels based on the level of the exercise, and allows the levels to be adjusted according to the items of the menu.

The sit-up exerciser having a secondary purpose of promoting a bowel movement of the present invention is an article that can be repeatedly fabricated by a common fabrication plant, and therefore the present invention has industrial applicability.

Although the exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A sit-up exerciser having a secondary purpose of promoting a bowel movement, comprising:

an exerciser body, a first pivot shaft and a second pivot shaft pivotally fixed inside said exerciser body;

a first drive motor disposed adjacent to the second pivot shaft inside the exerciser body, the first drive motor having a rotary plate attached thereto;

a first pivot lever, wherein one end of the first pivot lever is fixed to the rotary plate of the first drive motor, and another end of the first pivot lever is fixed to a first pivot arm, wherein the first pivot arm is fixed to the first pivot shaft and extends horizontally therefrom;

the first pivot arm fixed to the first pivot shaft, wherein one end of the first pivot lever is fixed to one end of the first pivot arm, and a second drive motor is disposed on another end of said first pivot arm;

a second pivot arm, wherein the second pivot arm is disposed on an upper portion of the first pivot arm of the first pivot shaft and extends horizontally therefrom;

a second pivot lever, wherein one end of the second pivot lever is fixed to the second pivot arm and another end of the second pivot lever is fixed on the second pivot shaft by being hinged to a third pivot arm, the third pivot arm horizontally extending from the second pivot shaft;

pivot plates disposed on the first and second pivot shafts, respectively, wherein each of the pivot plates has a heating mattress therein;

a waist support disposed between the pivot plates, wherein the waist support is vertically movable by a third drive motor; and a control unit, wherein the control unit controls a temperature of the heating mattress and a pivoting speed, a pivoting time and a pivoting angle of the pivot plates.

2. The sit-up exerciser of claim 1, wherein the control unit includes a wired or wireless control section, wherein the wired or wireless control section enables a movement to be repeated based on a specification selected by a user, provides a basic three-pattern menu by determining a level of an exercise, which matches a standard specification of an average person according to respective motion variables including speed, angle, temperature and time, and strong and weak levels based on the level of the exercise, and allows the levels to be adjusted according to items of the menu.

* * * * *